United States Patent [19]

Steinberg et al.

[11] Patent Number: 4,602,918

[45] Date of Patent: Jul. 29, 1986

[54] STABILIZING COAL-WATER MIXTURES WITH PORTLAND CEMENT

[75] Inventors: Meyer Steinberg, Melville; Coimbatore R. Krishna, Mount Sinai, both of N.Y.

[73] Assignee: The United States of America as represented by the United States Department of Energy, Washington, D.C.

[21] Appl. No.: 661,841

[22] Filed: Oct. 17, 1984

[51] Int. Cl.[4] ..... C10L 1/32

[52] U.S. Cl. ..... 44/51; 44/76; 44/15 R; 44/1 R

[58] Field of Search ..... 44/51, 76, 15 R, 1 R

[56] References Cited

U.S. PATENT DOCUMENTS

| | | | |
|---|---|---|---|
| 1,926,304 | 9/1933 | Pawlikowski | 44/51 |
| 2,090,393 | 8/1937 | Roberts et al. | 44/51 |
| 2,680,058 | 6/1954 | Harris et al. | 44/76 |
| 3,630,696 | 12/1971 | Milner et al. | 44/76 |
| 3,755,181 | 8/1973 | Henricks | 44/76 |
| 4,255,156 | 3/1981 | Sun et al. | 44/15 R |
| 4,261,699 | 4/1981 | Sun et al. | 44/51 |
| 4,355,999 | 10/1982 | Masologites | 44/15 R |
| 4,375,358 | 3/1983 | Swartz et al. | 44/51 |

FOREIGN PATENT DOCUMENTS

| | | | |
|---|---|---|---|
| 0113146 | 11/1984 | European Pat. Off. | 44/51 |

*Primary Examiner*—William R. Dixon, Jr.
*Assistant Examiner*—Margaret B. Medley
*Attorney, Agent, or Firm*—Margaret C. Bogosian; James W. Weinberger; Judson R. Hightower

[57] ABSTRACT

Coal-water mixes stabilized by the addition of portland cement which may additionally contain retarding carbohydrates, or borax are described.

5 Claims, No Drawings

STABILIZING COAL-WATER MIXTURES WITH PORTLAND CEMENT

The U.S. Government has rights in this invention pursuant to Contract Number DE-AC02-76CH00016, between the U.S. Department of Energy and Associated Universities Inc.

RELATED APPLICATIONS

Certain aspects of this invention are related to copending and concurrently filed U.S. patent application Ser. No. 661,842 filed Oct. 17, 1984, which is assigned to the same assignee.

BACKGROUND OF THE INVENTION

Coal is an abundant fossil fuel which is a convenient source of energy once it has been moved from mine to mouth to the site of use. Apart from the expense of mining, coal has two principal disadvantages. The first is that it is difficult and expensive to transport by the usual commercial means such as railroads, barges and ships. Second, since many coals contain high quantities of organic and inorganic sulfur, sulfur oxides, principally sulfur dioxide are present in large amounts in the combustion by-products. These oxides, when combined with moisture in the atmosphere form sulfurous and sulfuric acid which are the most damaging components of acid rain.

Much effort has been expended to alleviate or to avoid these problems. A principal effort to deal with the transportation problem has been to form coal-water mixes at or near the mine mount and to transport the mixes through pipe lines to the use site. However, coal particles do not remain suspended in water. Accordingly, any stoppage of the flow of the mixes can quickly lead to clogging of the pipelines, pumps and appurtenent equipment. Additionally, the coal must be utilized promptly upon arrival at the use site before it settles in the storage facility.

Heretofore a variety of organic and inorganic stabilizers have been studied in efforts to extend the storage time of the coal-water mixes. Those that are useful for this purpose are often expensive or burn with the production of by-products which are toxic or interfere with the smooth operation of the boiler equipment.

To limit the exhaust of sulfur oxides into the atmosphere, principal attention has focused on the direct injection of dry sorbent into the boiler and collection and disposal of spent sorbent and fly ash. The sorbent which has heretofore proven most attractive is limestone or calcium carbonate. It may be injected with the fuel, with the combustion air, or downstream in the combustion gases. The sorbent reacts with the oxides of sulfur to form a sulfated sorbent which is normally separated by electrostatic precipitation.

Limestone has a number of art recognized disadvantages as a sorbent. The above identified, concurrently filed patent application describes and claims the use of portland cement as a sorbent, and the advantages of such use.

THE INVENTION

It has now been discovered that portland cement is useful to stabilize coal-water mixes. Although it is useful with all varieties of coal, it is particularly useful with high sulfur coal where the cement serves not only to stabilize the mix, but also to reduce the sulfur oxide emissions.

This invention is applicable to all coal-water mixes. Typical commercial coal mixes will contain at least 50% coal particles by weight, based on the total weight of the mix, and may contain as much as 70% by weight. For most industrial purposes, therefore the mix will contain 50% to 70% by weight of coal.

When transported in such mixes, the coal is normally crushed to a particle size of from about 250 to 100 mesh. Such mixes may be usefully employed in this invention, although coal of a mesh appreciably above or below this range of particle sizes may also be employed.

Almost any amount of portland cement, even as low as 1% by weight based on the weight of the coal will appreciably enhance the storage life of coal-water mixes. There is no particular advantage in employing the cement at a concentration markedly in excess of 15% by weight, since this merely adds to the cost. For most purposes, the concentration of the cement is suitable if it is from 6% to 15% based on the weight of the coal. A particular advantage of these cement concentrations is that they are at least twice as high as the amount stoichiometrically necessary to remove all of the sulfur found in most sulfur containing coals, even high sulfur coals. The best ratio of cement to sulfur for limiting sulfur oxide emissions is from 2:1 to 3:1 as explained in the aforesaid copending application.

The stabilized mixtures may be formed merely by adding the cement to the mix with moderate agitation.

Portland cement, the common name for calcium silicate cement, consists principally of di- and tri-calcium silicates $(CaO)_2SiO_2$, and $(CaO)_3SiO_2$. It is manufactured by firing limestone with sand in a kiln at temperatures of the order of up to 1500° C. (2732° F.). The fired product is then crushed and ground to form the cement product. Thus, the limestone is calcined and the lime is chemically bound with silica so that it cannot be affected by such impurities as iron oxide and aluminum oxide that may be present in fly ash and mineral matter during the coal combustion.

The following table shows typical chemical compositions of several samples of some American portland cements. All of these are useful in the practice of this invention, but portland cement type III is preferred since it consistently has the highest CaO content.

TABLE

| | Composition of Some of American Portland Cements | | | | | | | | | |
|---|---|---|---|---|---|---|---|---|---|---|
| ASTM Type | CaO | MgO | $Al_2O_3$ | $Fe_2O_3$ | $SiO_2$ | $TiO_2$ | $Na_2O$ | $K_2O$ | $SO_3$ | Free CaO |
| I | 63.8 | 3.7 | 5.6 | 2.4 | 20.7 | 0.23 | 0.21 | 0.51 | 1.6 | 0.4 |
| | 63.1 | 2.5 | 4.7 | 3.0 | 22.1 | 0.21 | 0.06 | 1.30 | 1.7 | 0.2 |
| | 65.8 | 1.1 | 4.7 | 2.1 | 22.2 | 0.30 | 0.40 | 0.19 | 1.6 | 1.6 |
| | 62.8 | 1.7 | 6.7 | 2.5 | 21.1 | 0.39 | 0.95 | 0.51 | 1.8 | 2.0 |
| II | 61.4 | 3.1 | 4.8 | 4.8 | 20.8 | 0.21 | 0.06 | 1.30 | 1.8 | 0.9 |
| | 64.9 | 1.9 | 4.0 | 2.1 | 24.0 | 0.23 | 0.23 | 0.55 | 1.7 | 1.5 |
| III | 65.6 | 1.4 | 5.2 | 2.5 | 20.0 | 0.27 | 0.21 | 0.44 | 2.3 | 1.8 |
| | 63.3 | 4.3 | 5.1 | 2.0 | 20.3 | 0.21 | 0.19 | 0.28 | 2.5 | 1.9 |

TABLE -continued

| ASTM Type | Composition of Some of American Portland Cements | | | | | | | | | |
|---|---|---|---|---|---|---|---|---|---|---|
| | CaO | MgO | $Al_2O_3$ | $Fe_2O_3$ | $SiO_2$ | $TiO_2$ | $Na_2O$ | $K_2O$ | $SO_3$ | Free CaO |
| IV | 59.6 | 3.0 | 4.6 | 5.0 | 22.9 | 0.23 | 0.06 | 1.19 | 1.3 | 0.4 |
| | 63.6 | 1.1 | 3.7 | 3.1 | 25.2 | 0.19 | 0.33 | 0.01 | 1.9 | 0.4 |
| V | 64.3 | 1.7 | 3.1 | 3.3 | 24.4 | 0.19 | 0.08 | 0.22 | 1.4 | 0.5 |
| | 62.4 | 2.5 | 1.9 | 1.3 | 26.1 | 0.12 | 0.10 | 0.15 | 2.0 | 1.8 |
| | 63.3* | 1.2 | 3.3 | 4.7 | 23.1 | | 0.08 | 0.37 | 1.7 | |

*Corrected for free CaO

While there is no intention to be limited by theory, the present belief is that the ability of the coal particles to precipitate from the water is inhibited by the hydration of the cement. The hydrated cement forms a continuous network which surrounds the coal particles and holds them in suspension. However, if the hydration proceeds too far the whole network coalesces and the slurry will harden. This, of course, is highly undesirable. In the practice of this invention, therefore, it is preferred to add certain retarding carbohydrates to the slurries in addition to the cement, especially at the higher concentrations.

It is well known that certain carbohydrates will retard the hydration of cement and therefore the hardening of the composition. This effect is discussed by Thomas and Birchall in Cement and Concrete Research, Vol. 13, pp. 830–842, published in 1983 by Pergamon Press. For purposes of this description and claims, these carbohydrates, which are a well known class, are referred to as "retarding carbohydrates".

Sugars are one family of compounds known for their use as retarding carbohydrates. When used in the compositions of this invention the sugars appear to impart a thixotropic property to the mixes, and this greatly enhances their stability. This property is especially valuable in the event of pipeline stoppages since it substantially limits precipitation of coal or cement particles in joints, valves, pumps and other components of the pipeline.

The preferred retarding sugars from the point of view of efficacy and availability are sucrose, glucose, maltose, lactose, cellobiose and raffinose. Of these, sucrose is preferred since it is highly active and universally available at relatively low cost.

Typically the concentration of retarding carbohydrate in the portland cement stabilized coal water mixes of this invention is from 0.1% to 2.0%, preferably 0.5% to 1.0% based on the total weight of the mix. However, even small amounts of carbohydrates are useful.

It has also been observed that the addition of borax ($Na_2B_4O_7.10H_2O$) at a concentration of from about 0.1% to 2% based on the total weight of the mix often makes it possible to reduce the amount of cement employed in the mix. This may be desirable when the cement is employed principally as a stabilizing agent, and is not necessary to neutralize a high sulfur coal. Small amounts of surfactants may be similarly employed.

Those sklled in the art will recognize that some testing will be required to select optimum concentration conditions from the many possibilities which arise from the ranges set forth above. For example, smaller coal particles may be stabilized with lesser amounts of cement.

The following non-limiting examples are given by way of illustration only.

EXAMPLES 1–9

The compositions shown in the following table were prepared by mixing the described amounts of the listed components. The coal used was a Kentucky No. 9, a bituminous coal at a particle size of from 50 to 150 microns. The particle size of the portland cement type III employed was less than 20 microns. Stability was observed visually and determined by the separation of the coal to leave an essentially clear top layer of water. As thus measured, that is by the failure of a clear layer to appear, all of the compositions in the table were stable for at least three days.

In the examples, all weights are in grams.

TABLE

| Ex | COAL | WATER | CEMENT | CARBOHYDRATE[1] | SURFACTANT[2] | BORAX |
|---|---|---|---|---|---|---|
| 1 | 44 | 50 | 6.0 | 0.5 | — | — |
| 2 | 50 | 50 | 3.0 | 1.0 | — | — |
| 3 | 50 | 50 | 4.5 | 1.0 | — | — |
| 4 | 50 | 50 | 6.0 | 1.0 | — | — |
| 5 | 50 | 50 | 6.0 | — | 1.0 | — |
| 6 | 50 | 50 | 2.0 | — | 1.0 | — |
| 7 | 50 | 50 | 6.0 | — | — | 1.0 |
| 8 | 55 | 45 | 6.0 | — | — | 1.0 |
| 9 | 45 | 50 | 5.0 | 0.1 | — | — |

[1]Granulated sucrose

[2]A commercially available soap containing principally alkali metal salts of higher carboxylic acids.

EXAMPLE 10

A mix similar to those described in the previous examples was prepared to contain 50 grams of Upper Thacker coal (30 to 40 micron particle size), 50 grams of water and 6.0 grams of the same portland cement type III. It was stable for at least three days.

We claim:

1. A coal-water mix for use as a fossil fuel containing up to 70% by weight coal particles, based on the total weight of the mix, stabilized by the presence in the mix of up to 15% by weight, based on the weight of the coal, of portland cement, said portland cement stabilizing the mix by greatly extending the time that the coal particles remain in suspension, thus eliminating problems of transporting and storing the mix which result when said coal particles come out of suspension.

2. A coal-water mix as in claim 1 wherein the portland cement is type III portland cement.

3. A coal-water mix as in claim 1 additionally containing a carbohydrate to retard the hardening of the mix.

4. A coal-water mix as in claim 3 wherein the retarding carbohydrate concentration is up to 2% based on the weight of the cement.

5. A coal-water mix as in claim 1 additionally containing from 0.1% to 2% by weight borax, based on the total weight of the mix, said borax decreasing the amount of portland cement required in the mix.

* * * * *